US005690851A

United States Patent [19]

Yoshioka et al.

[11] Patent Number: 5,690,851

[45] Date of Patent: Nov. 25, 1997

[54] INDUCTION HEATING APPARATUS FOR DRINK CAN

[75] Inventors: Tsuyoshi Yoshioka, Tokyo; Masami Matsunaga; Tetsuya Takatomi, both of Sagamihara; Hideo Kanai, Shimada; Tsutomu Ishima, Inagi, all of Japan

[73] Assignees: SPC Electronics Corp.; Daiwa Can Co., both of Tokyo, Japan

[21] Appl. No.: 539,312

[22] Filed: Oct. 4, 1995

[30] Foreign Application Priority Data

Oct. 7, 1994 [JP] Japan ..... 6-243749

[51] Int. Cl.[6] ..... H05B 6/10

[52] U.S. Cl. ..... 219/635; 219/624; 219/630; 219/660; 219/674; 221/150 A

[58] Field of Search ..... 219/635, 604, 219/643, 670, 676, 673, 674, 647, 624, 629, 660, 630; 221/150 A, 150 R

[56] References Cited

U.S. PATENT DOCUMENTS 2,818,483 12/1957 Blume ..... 219/610
4,371,768 2/1983 Pozna ..... 219/670
4,704,509 11/1987 Hilmersson et al. ..... 219/633
5,350,902 9/1994 Fox et al. ..... 219/633
5,352,871 10/1994 Ross et al. ..... 219/633

FOREIGN PATENT DOCUMENTS 5716391 11/1978 Japan .

*Primary Examiner*—Philip H. Leung
*Attorney, Agent, or Firm*—Bachman & LaPointe, P.C.

[57] ABSTRACT

A drink can induction heating apparatus includes a ferrite core having a plurality of projected portions and recesses formed between the adjacent projected portions. When a drink can is set in a position to be heated, each of the projected portions is oriented toward a longitudinal axis of the drink can and a particular portion of a circumferential wall of the drink can. The apparatus further includes a saddle-shaped heating coil which is partly received in the recesses of the ferrite core and covers a region around the foregoing particular portions of the drink can in a non-contact manner, and an inverter for feeding the AC power to the heating coil. The inverter is arranged to produce the AC power at a resonance frequency which corresponds to one of 5 kHz to 15 kHz where equivalent resistance values of an aluminum can and a steel can approximate to each other.

4 Claims, 4 Drawing Sheets

INDUCTION HEATING APPARATUS FOR DRINK CAN

BACKGROUND OF THE INVENTION

1. Field of the Invention

The present invention relates to a dispenser or a vending machine of drink cans or drink-containing cans in which a drink can comes out automatically when a buyer puts a given coin into a coin slot of the machine more specifically, the present invention relates to a drink can induction heating apparatus for induction-heating a drink can stored in the vending machine upon actually vending the drink can so as to prevent deterioration of a taste of a drinking liquid contained in the can.

2. Description of the Prior Art

In general, a conventional drink can vending machine has four to six columns for storing drink cans and four-line column chutes for each of the columns. Temperatures of the drink cans are controlled such that, for example, the columns storing the drink cans for "drinking cold" are controlled to 5° C.~10° C. while the columns storing the drink cans for "drinking hot" are controlled to 50° C.~60° C. When a buyer puts a given coin into a coin slot and pushes a selection button, the cold or hot drink can selected by the buyer is discharged at an outlet via the column chute.

However, since the drink cans for "drinking hot" are stored in the columns kept at high temperatures, it has been unable to vend those drink cans that contain drinks, such as milk, dairy drinks and citrus-fruit drinks, which are liable to change in quality and increase bacteria therein when stored at high temperatures.

In recent years, instead of the foregoing vending machine, a vending machine equipped with an induction heating apparatus has been available, wherein the drink cans for "drinking hot" are not stored at a high temperature in the columns, but kept at a temperature (about 35° C.) close to an ordinary temperature and wherein, based on a selection signal from the selection button pressed by the buyer, a selected drink can is transferred to the induction heating apparatus via the column chute so as to be heated there and discharged to the outlet for the buyer to pick it up. In the vending machine of this type, since the drink can in the column is not kept at a high temperature, but kept at a temperature close to the ordinary temperature and heated upon offering to the buyer, deterioration In quality of the canned drinking liquid during storage can be prevented so that the high-quality hot drink can be served to the buyer.

The drink can induction heating apparatus used in the foregoing vending machine includes a heating coil, an inverter for feeding the AC power at a given frequency to the heating coil, a carrier mechanism for carrying a drink can to the induction heating apparatus from the column chute, and a rotation mechanism for rotating the drink can with respect to a longitudinal axis thereof upon heating.

In general, a drink can is formed by seaming a cap or lid to a bottomed tubular can body after filling a drinking liquid into the can body. The heating coil is in the form of a cylindrical coil with several turns surrounding the whole of the outer circumference or periphery of the drink can, or a coil covering a portion of the outer periphery of the drink can.

In general, the heating coil and the inverter are arranged inside the narrow vending machine, particularly, at a narrow space between the columns keeping the drink cans and the outlet of the drink can. Accordingly, as disclosed in, for example, Japanese Second (examined) Patent Publication No. 57-16394, in the drink can heating apparatus of the vending machine, a frequency of the AC power produced by the inverter is usually set to about 20 kHz~30 kHz at which an internal resonance circuit of the inverter and the heating coil can be reduced in size.

A heating power applied to an objected to be heated due to the induction heating is known to be in proportion to the square root of effective permeability (μ) of the object to be heated. Accordingly, the heat efficiency of a drink can formed of steel (hereinafter referred to as "steel can") having an effective permeability μ greater than 100 is relatively good. On the other hand, the heat efficiency of a nonmagnetic drink can, such as a drink can formed of aluminum (hereinafter referred to as "aluminum can"), having an effective permeability of about 1 is significantly bad. Further, as described above, since the heating coil and the inverter are disposed in the narrow space, the heating coil and the power or the current fed from the inverter can not be increased so much. Accordingly, it has been practically difficult to heat the aluminum can by the induction heating so that the drink can to be heated has been limited to the steel can.

On the other hand, in the recent drink can market, it has been widely available that drink cans, whether the steel cans or the aluminum cans, containing drinks, such as oolong, black tea, green tea and coffee, are heated in advance and sold via the vending machines. Under the circumstances, it has been demanded to provide a vending machine with an induction heating apparatus which can heat the aluminum can with a heat efficiency approximate to that of the steel can for expansion of merchandise.

However, as described above, since the aluminum can, which is non-magnetic, is poor in heating efficiency, it has been difficult to employ the aluminum can in the conventional induction heating apparatus from the commercial point of view.

Further, in the conventional heating coil, the magnetic flux concentrates to a lid portion of the drink can so that a joint portion (lid seamed portion) between the lid and the circumferential wall of the drink can is overheated locally where the heat conduction to the contained liquid is not liable to be achieved. Particularly, in a three-piece steel can (welded can, bonded or cemented can or the like) having a seamed portion at the circumferential wall, the magnetic flux is liable to concentrate to the metal edges at the foregoing lid seamed portion and the circumferential-wall seamed portion so that temperatures at these portions increase to high values locally. As a result, there have been raised problems that the seamed portions are separated due to the heat to produce leakage of the contained liquid, that the buyer feels uncomfortable upon holding the drink can which is locally too hot, and that lips are scalded upon touching the lid seamed portion.

SUMMARY OF THE INVENTION

Therefore, it is an object of the present invention to provide an improved drink can induction heating apparatus.

According to one aspect of the present invention, a drink can induction heating apparatus for induction-heating a drink can in a vending machine, the drink can having a bottomed tubular can body with a drinking liquid contained therein, comprises a ferrite core having a plurality of projected portions each oriented toward a longitudinal axis of the drink can and a given portion of a circumferential wall of the drink can in a non-contact manner when the drink can is temporally held at a given position in the vending machine, the ferrite core further having one or more recesses formed between the projected portions; a saddle-shaped heating coil having a central portion which receives therethrough at least one of the plurality of projected portions of the ferrite core, the heating coil partly held in the one or more recesses and having a coil surface which covers a portion of the circumferential wall of the drink can in a non-contact manner; and an inverter for producing AC power at a given frequency for feeding to the heating coil, wherein, when the AC power is fed to the heating coil, one or more magnetic circuits are formed between the projected portions of the ferrite core and the circumferential wall of the drink can confronting the projected portions.

It may be arranged that one of the projected portions which is located most remotely along a longitudinal axis of the ferrite core, is oriented toward the circumferential wall of the drink can at a portion which is located closer to a middle portion of the drink can than lid seamed portions located at both axial sides of the drink can are located relative to the middle portion.

It may be arranged that the inverter includes a resonance circuit for producing the AC power at a frequency no greater than a value where a current penetration depth becomes about five times a thickness of the circumferential wall of the drink can in case the drink can is formed of a non-magnetic material.

It may be arranged that the inverter includes a resonance circuit for producing the AC power at a frequency where equivalent resistance values of a non-magnetic material and a magnetic material used in the bottomed tubular can bodies approximate to each other, the frequency corresponding to one of frequencies 5 kHz to 15 kHz.

It may be arranged that the resonance circuit includes a resonance capacitor having a given capacitance and the heating coil which are connected electrically in series or in parallel.

BRIEF DESCRIPTION OF THE DRAWINGS

The present invention will be understood more fully from the detailed description given hereinbelow, taken in conjunction with the accompanying drawings.

In the drawings.

DESCRIPTION OF THE PREFERRED EMBODIMENT

Now, preferred embodiments of the present invention will be described hereinbelow with reference to the accompanying drawings.

Figure 1B:
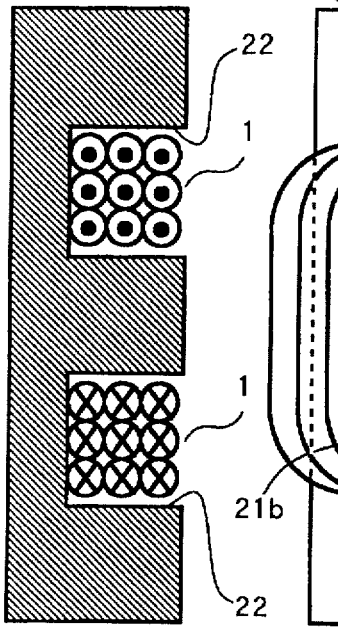
FIG. 1B is a sectional view taken along line A–A' in FIG. 1A.
Figure 1A:
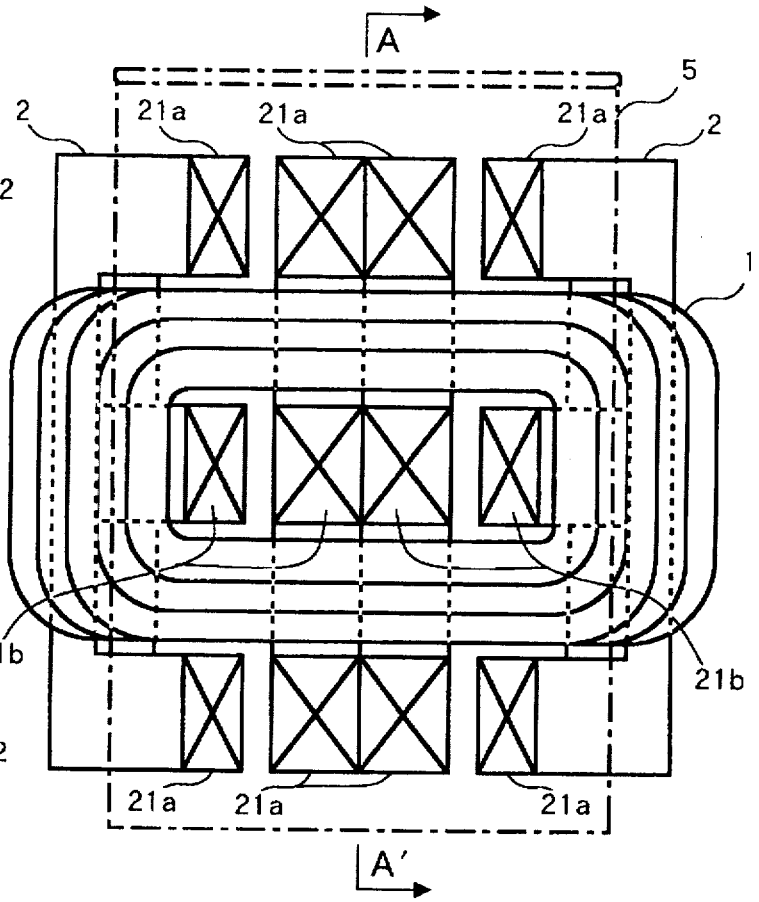
FIG. 1A is a front view showing a heating coil employed in a drink can induction heating apparatus according to a first preferred embodiment of the present invention.
Figure 1C:
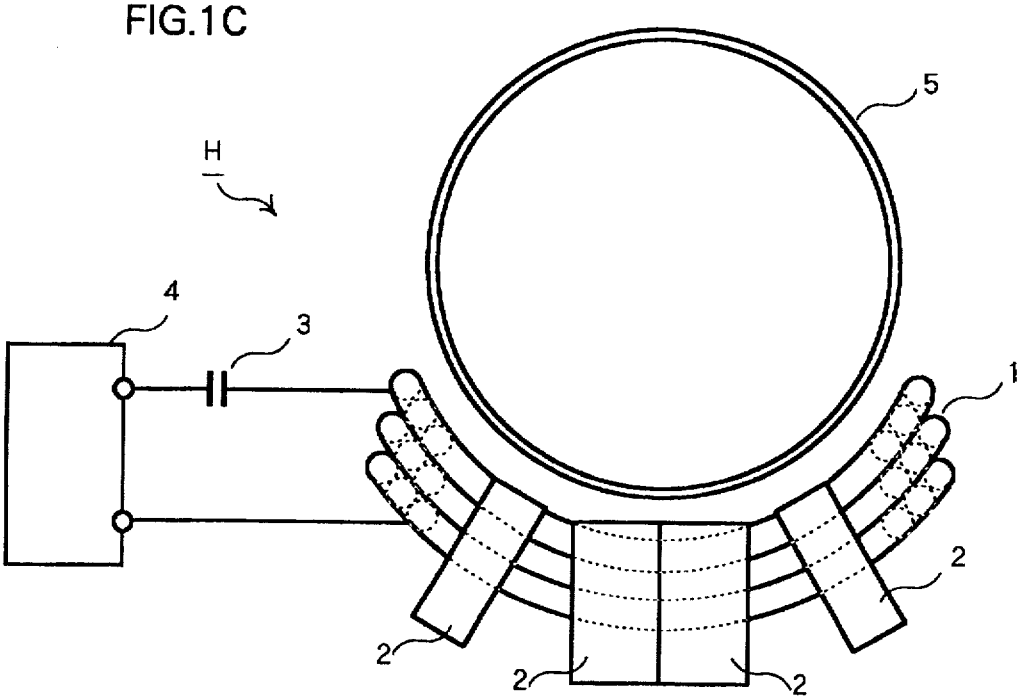
FIG. 1C is a diagram showing a relationship of connection between the heating coil and a power supply system according to the first preferred embodiment.

FIG. 1A is a front view showing a heating coil employed in a drink can induction heating apparatus according to a first preferred embodiment of the present invention, FIG. 1B is a sectional view taken along line A–A' in FIG. 1A, and FIG. 1C is a diagram showing a relationship of connection between the heating coil and a power supply system according to the first preferred embodiment, in the figures, symbol H denotes the drink can induction heating apparatus, numeral 1 the heating coil, numerals 2 denote ferrite cores each having an E-shape in section and combined with the heating coil 1 to form a heating coil unit, numeral 3 a resonance capacitor connected in series between the heating coil 1 and an inverter 4, numeral 4 the inverter for generating the AC power at a given frequency for feeding to the heating coil 1, and numeral 5 a bottomed cylindrical drink can.

The heating coil 1 is a saddle-shaped coil formed by, for example, stacking the Litz wire wound in a spiral shape in a given number of, such as three, stages or layers, and bending or curving the three-layered coil in a circumferential direction of a body wall or a circumferential wall of the drink can 5.

It is to be appreciated that "saddle-shaped coil" represents a coil having, for example, a shape of a saddle which is put on the back of a horse for riding or a shape of a semicylindrical water pipe provided along the periphery of a roof of a house for receiving and guiding rain.

Each ferrite core 2 is formed with a pair of projected portions 21*a*, 21*a* at opposite ends in a longitudinal direction thereof and with a projected portion 21*b* at a middle portion thereof. Accordingly, a pair of recesses 22, 22 are formed between the end projected portions 21*a*, 21*a* and the middle projected portion 21*b*, respectively. The middle projected portion 21*b* of each ferrite core 2 is arranged at a center vacant portion of the spiral heating coil 1 as passing therethrough. Further, the end projected portions 21*a*, 21*a* of each ferrite core 2 are arranged to sandwich therebetween longitudinal outer sides of the heating coil 1. The heating coil 1 is fitted in the recesses 22 of all the ferrite cores 2 so as to be substantially level with surfaces of all the end and middle projected portions. Although not shown in the figures, an insulating member is interposed between the heating coil 1 and an inner surface of each of the recesses 22 of the ferrite cores 2.

Each ferrite core 2 is arranged orthogonal to the longitudinal direction of the heating coil 1, that is, along a longitudinal axis (can axis) of the drink can 5. Further, the end and middle projected portions 21*a*, 21*a*, 21*b* of each ferrite core 2 confront the circumferential wall of the drink can 5 at portions thereof other than lid seamed portions located at both axial ends of the drink can 5, that is, at portions thereof away from the lid seamed portions toward a middle portion of the drink can 5, and are oriented toward the longitudinal axis of the drink can 5. Specifically, the surface (magnetic flux passage surface) of each of the projected portions 21*a*, 21*b* is arranged substantially in parallel with the circumferential wall of the drink can 5. Accordingly, when the AC power is fed to the heating coil 1, one or more magnetic circuits are formed between the end and middle projected portions 21*a*, 21*b* and the circumferential wall of the drink can 5.

Since it is sufficient in the present invention that the ferrite core has a plurality of projected portions and one or more recesses between the projected portions and at least one of the projected portions is arranged to pass through the center vacant portion of the heating coil 1, for example, two ferrite cores each having a U-shape in section may be combined in series to form a ferrite core having an E-shape in section.

Figure 2:
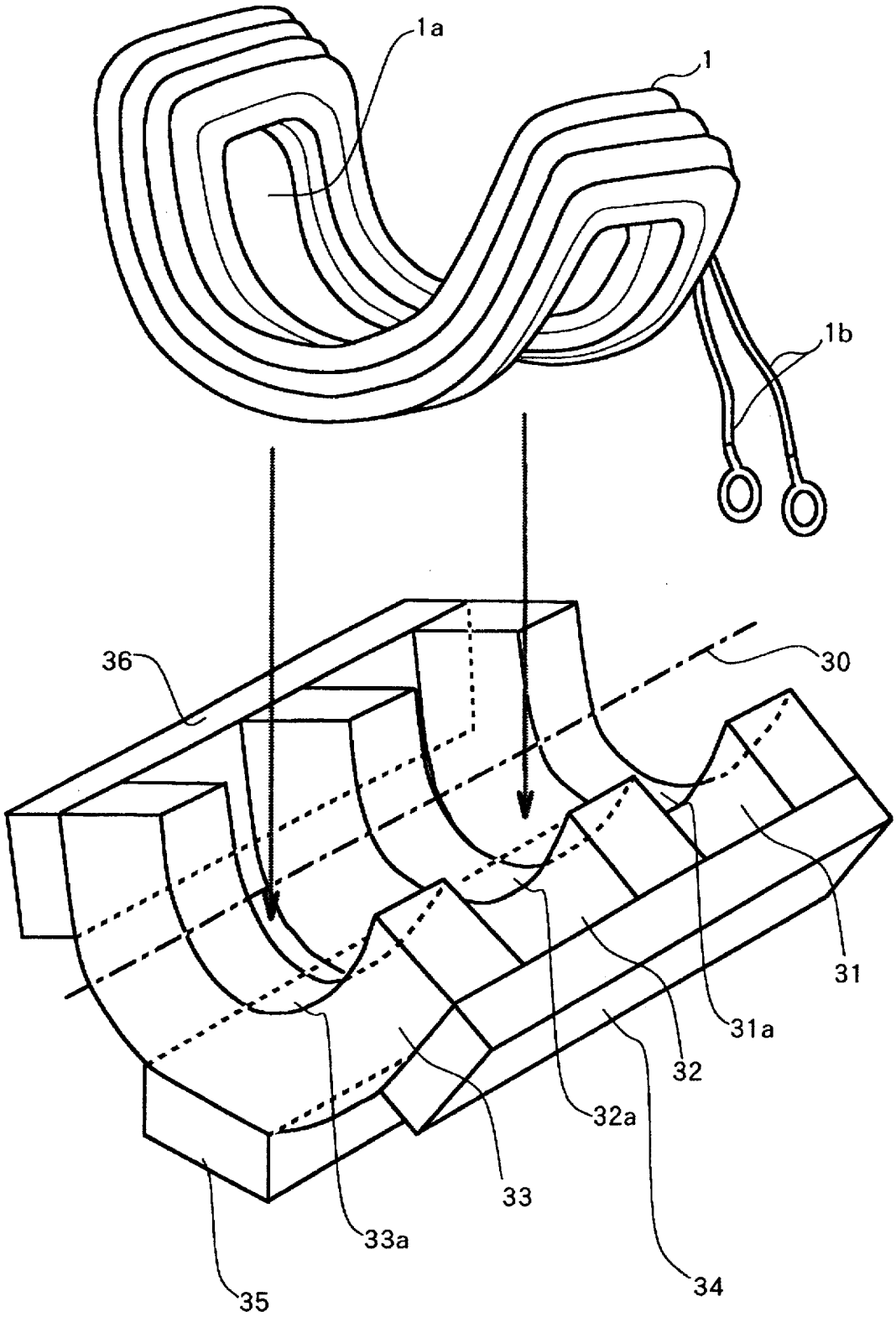
FIG. 2 is an exploded perspective view for explaining a structure of a ferrite core according to another preferred embodiment of the present invention.

Further as shown in FIG. 2, it may be arranged that three fan-shaped ferrite cores 31, 32 and 33 having the same shape and a given thickness are arranged in parallel with each other at regular intervals along a longitudinal or can axis 30 of the drink can, and that these three ferrite cores 31,32 and 33 are coupled with each other at their outer sides by connector ferrite cores 34, 35 and 36 so as to form recesses between the adjacent fan-shaped ferrite cores for receiving the saddle-shaped heating coil 1 therein. The fan-shaped ferrite cores 31, 32 and 33 are formed by cutting radially an annular plate having a circular opening at the center thereof, in the ferrite core having the foregoing structure, inner sides 31*a*, 32*a* and 33*a* of the three fan-shaped ferrite cores 31, 32 and 33 work like the foregoing projected portions 21*a*, 21*b*, 21*a*, respectively. Accordingly, when the heating coil 1 is mounted in the recesses and fed with the AC power, one or more magnetic circuits are formed relative to the confronting circumferential wall of the drink can.

Advantages of the ferrite core structure of FIG. 2 are as follows:

First, only the ferrite core can be produced with high density and high accuracy, independent of the heating coil 1. Positional accuracy of the inner sides 31*a*, 32*a* and 33*a* of the ferrite cores 31, 32 and 33 is largely increased as compared with the combination of a plurality of the ferrite cores each having an E-shape in section, which is particularly important for increasing the magnetic flux density of the foregoing magnetic circuits. Second, the mass production of heating coil units each having the heating coil 1 and the ferrite core is made possible. Specifically, the heating coil 1 may be formed in advance by winding the wire into a saddle shape, with a center vacant portion 1*a* and connection terminals 1*b*, matching the shape provided by the recesses between the adjacent ferrite cores 31, 32 and 33. As shown by arrows in FIG. 2, assembling of the heating coil unit can be achieved by simply fitting the heating coil 1 into the recesses with the center fan-shaped ferrite core 32 passing through the center vacant portion 1*a* of the heating coil 1. Accordingly, since the assembling operation of the heating coil 1 and the ferrite core can be simplified, the mass productivity of the heating coil unit and thus the drink can induction heating apparatus is enhanced, leading to reduction in cost.

Although not shown in the figures, on the surface of the heating coil 1 is disposed a semicylindrical pad or pedestal of a non-magnetic material for holding the circumferential wall of the drink can 5 in a non-contact relationship to the end and middle projected portions and the coil surface. Further, in the drink can induction heating apparatus H, the known drink can rotating device for rotating the drink can upon heating so as to agitate the contained liquid is provided for shortening a heating time of the drink can. For example, it is arranged that friction rollers driven by a motor are projected on an upper side of the foregoing pedestal upon heating so as to transmit the torque to the drink can from the friction rollers to rotate the drink can due to the friction between the friction rollers and the drink can.

Hereinbelow, a relationship between the AC power fed to the heating coil 1 from the inverter 4 and the heat efficiency of the drink can in the drink can induction heating apparatus H will be described.

Figure 4:
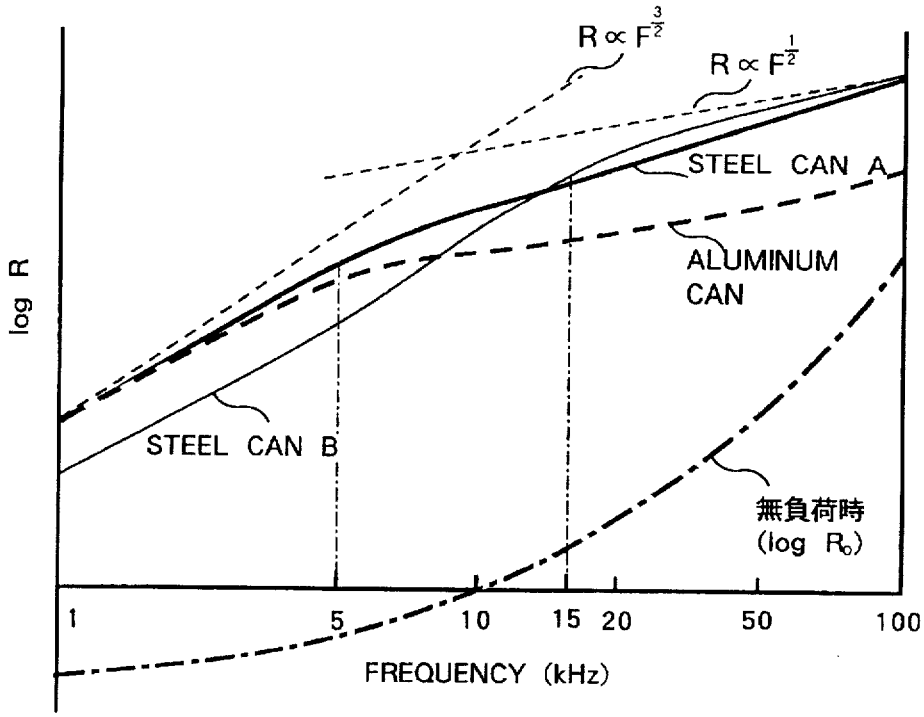
FIG. 4 is a diagram showing a relationship between equivalent resistance values R of a steel can A having a circumferential wall thickness of 0.22 mm, a steel can B having a circumferential wall thickness of 0.07 mm and an aluminum can having a circumferential wall thickness of 0.12 mm and equivalent resistance values Ro of a heating coil of the heating coil unit at the time of no load, in terms of frequencies from 1 kHz to 100 kHz of the AC power applied to the heating coil.

FIG. 4 is a diagram showing a relationship between equivalent resistance values R of a steel can A having a circumferential wall thickness of 0.22 mm, a steel can B having a circumferential wall thickness of 0.07 mm and an aluminum can having a circumferential wall thickness of 0.12 mm and equivalent resistance values Ro of only the heating coil 1 at the time of no load, in terms of frequencies F from 1 kHz to 100 kHz of the AC power applied to the heating coil 1. The shown relationship is the result of measurement using an impedance analyzer, wherein the heating coil unit shown in FIGS. 1A to 1C was used to obtain the result.

As seen in FIG. 4, the steel can A has a region at frequencies higher than about 10 kHz where the equivalent resistance value R is in proportion to about the square root of the frequency and another region at frequencies lower than about 10 kHz where the equivalent resistance value R is in proportion to about the square root of the third power of the frequency. The steel can B reveals a similar variation with respect to about 20 kHz.

On the other hand, in case of the aluminum can, the equivalent resistance value R is considerably small at a frequency region no less than about 20 kHz as compared with each of the steel cans A and B. At a frequency region from about 20 kHz to about 5 kHz. The equivalent resistance value R is substantially kept constant. At a frequency region no more than about 5 kHz, the equivalent resistance value R is lowered in proportion to about the square root of the third power of the frequency similar to each of the steel cans A and B. As seen from FIG. 4, the equivalent resistance value R of the aluminum can gets close to and substantially equal to the equivalent resistance value R of each of the steel cans A and B at a frequency region of about 5 kHz~20 kHz.

In case of the aluminum can as an object to be heated, it is known that a current penetration depth is 0.83 mm around 10 kHz and 0.68 mm around 15 kHz. Accordingly, when, for example, induction-heating an aluminum can having a circumferential wall thickness of 0.12 mm, by arranging that the inverter 4 produces the AC power at a frequency no greater than a value where a current penetration depth (0.68 mm) becomes about five times the circumferential wall thickness, and supplies it to the heating coil 1, the eddy current density in the aluminum can is increased to enhance the heat efficiency thereof.

In general, a circumferential wall thickness of a steel can is 0.05 mm~0.25 mm and that of an aluminum can is 0.1 mm~0.15 mm so that, as clear from FIG. 4, there surely exists a region in a frequency range of 5 kHz~15 kHz where the equivalent resistance values of the respective cans get close to each other. Accordingly, by providing a resonance circuit in the inverter 4 to produce the AC power at a resonance frequency between 5 kHz~15 kHz which renders the equivalent resistance values of the non-magnetic aluminum can and the magnetic steel can close to or approximate to each other and by feeding this AC power to the heating coil 1, it is possible to achieve a drink can induction heating apparatus which can induction-heat drink cans of different kinds or types with highly improved heat efficiency.

Figure 5:
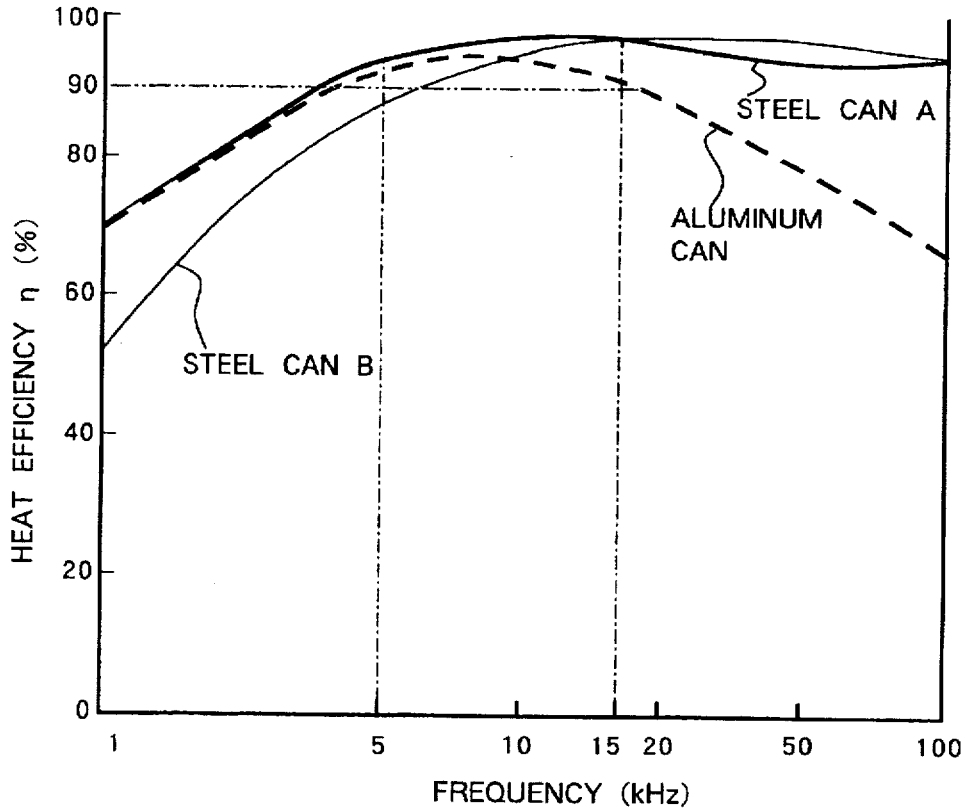
FIG. 5 is a diagram showing a relationship of associated values, actually derived, between heat efficiencies $\eta$ of the steel can A, the steel can B and the aluminum can, respectively, and frequencies of the AC power applied to the heating coil of the heating coil unit.

FIG. 5 is a diagram showing a relationship of associated values, actually derived, between heat efficiencies $\eta$ of the steel can A, the steel can B and the aluminum can, respectively, and frequencies of the AC power applied to the heating coil 1 of the heating coil unit shown in FIGS. 1A to 1C. These associated values were derived based on the equivalent resistance values R of the respective cans and the equivalent resistance values Ro of the heating coil 1 at the time of no load shown in FIG. 4, using the following equation:

$$\eta=\{1-(Ro/R)\}\times 100(\%)$$

As clear from FIG. 5, the heat efficiency η of the aluminum surely becomes no less than 90% in the frequency range of 5 kHz~15 kHz, which is highly excellent. Further, in this frequency range, the heat efficiencies η of the steel cans A and B are both essentially no less than 90%. Accordingly, these drink cans of different kinds can be induction-heated under substantially the same frequency conditions. Referring back to FIGS. 1A to 1C, in view of the foregoing results and analysis, the inverter 4 has a resonance circuit including at least a capacitance of a resonance capacitor 3 and an inductance of the heating coil 1 as components thereof. A resonance frequency of the resonance circuit is set to one of 5 kHz to 15 kHz. As described above, when heating the aluminum can having a circumferential wall thickness of 0.12 mm, the resonance frequency is set to a value no greater than a frequency where a current penetration depth becomes about five times the circumferential wall thickness, that is, 0.68 mm, and thus no greater than 15 kHz. On the other hand, when heating the steel can having a circumferential wall thickness of 0.05 mm~0.25 mm in addition to the foregoing aluminum can, the resonance frequency is set to a value, such as around 7 kHz, where the equivalent resistance values of both the aluminum and steel cans get close to each other.

The resonance frequency may be set fixedly or variably. Specifically, when necessity occurs to change a material of a drink can from a magnetic material to a non-magnetic material, and vice versa, or to change a circumferential wall thickness of a drink can, a resonance frequency may be changed within the foregoing resonance frequency range, in this case, for example, a variable capacitor may be used as the resonance capacitor 3, or an adjusting reactance incorporated in the inverter 4 may be used for the resonance circuit to change the resonance frequency.

Now, an operation of the foregoing drink can induction heating apparatus will be described hereinbelow.

The drink can 5 for "drinking hot" is stored at the ordinary temperature in the column, in this state, when the buyer puts a coin into the coin slot and pushes the selection button, the selected drink can 5 from the column slides on the column chute toward the saddle-shaped heating coil 1 in the induction heating apparatus H. Subsequently, the drink can 5 is stopped by stopper rollers (not shown) or the like and temporally held at a given position on the pedestal. On the other hand, in case of a drink can for "drinking cold", the drink can passes by the induction heating apparatus H and is discharged to the outlet without being heated.

When the drink can 5 is held at the given position on the pedestal, the friction rollers are projected on the upper side of the pedestal. Accordingly, the drink can 5 is slightly separated upward from the upper side of the pedestal, as being held by the friction rollers. When the motor is driven to rotate the friction rollers, the torque is transmitted from the friction rollers to the drink can so as to rotate the drink can 5 about the longitudinal axis thereof. Simultaneously, the AC power at the foregoing resonance frequency is produced by the inverter 4 and fed to the heating coil 1. As a result, the alternating magnetic field is generated from a central portion of the coil surface of the heating coil 1 toward the outer periphery thereof.

On the other hand, since the heating coil 1 is combined with the ferrite cores 2 arranged as shown in FIGS. 1A to 1C, the magnetic flux concentrates to the end and middle projected portions 21*a*, 21*a*, 21*b* of each of the ferrite cores 2. As a result, the magnetic flux leaking to the outside in the longitudinal direction of each of the ferrite cores 2 is suppressed. Further, since each of the projected portions 21*a*, 21*b* of the ferrite cores 2 is oriented toward the longitudinal axis and the circumferential wall of the drink can 5, the magnetic flux concentrates to the circumferential wall of the drink can 5 at positions near the projected portions 21*a*, 21*b* of the ferrite cores 2 to produce the eddy currents at those positions. Accordingly, the drink can 5 is heated by the Joule heat caused by the eddy currents and thus the contained liquid in the drink can 5 is heated.

Figure 3:
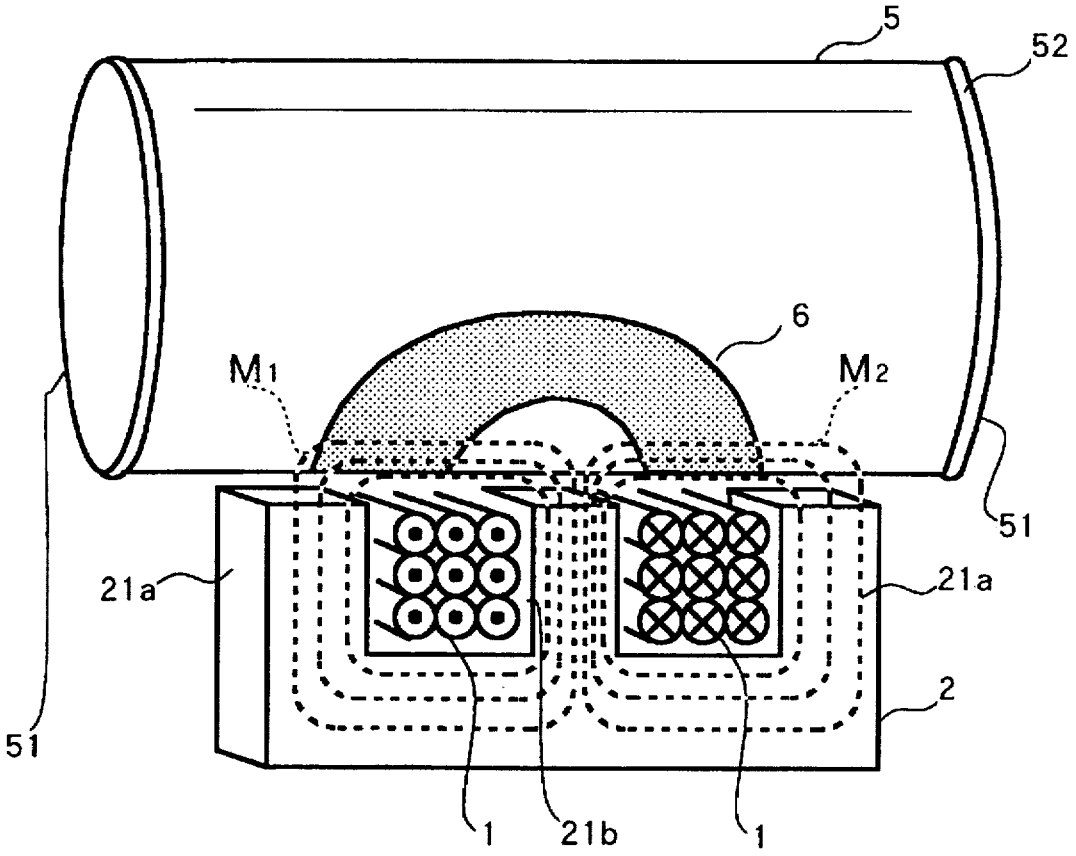
FIG. 3 is an explanatory diagram showing a heat distribution of a drink can when heated by a heating coil unit shown in FIGS. 1A to 1C.

FIG. 3 is a diagram for explaining a heating state of the drink can 5 or the contained liquid achieved by the heating coil unit shown in FIGS. 1A to 1C. in the figure, numeral 6 represents a heat distribution. As shown in FIG. 3, according to the heating coil unit of this preferred embodiment, the middle projected portion 21*b* of each ferrite core 2 is directed to a middle portion, along the longitudinal axis, of the circumferential wall of the drink can 5, and the end projected portions 21*a*, 21*a* of each ferrite core 2 is directed to the circumferential wall of the drink can 5 near the lid seamed portion. Accordingly, two magnetic circuits M1, M2 are formed between each ferrite core 2 and the drink can 5. As a result, the heat distribution 6 at the circumferential wall of the drink can 5 is formed into essentially a doughnut shape with the middle projected portions 21*b* as the center of the doughnut. Thus, since the concentration of heat is ensured, the drink can 5 can be heated with high efficiency.

Further, since the magnetic leakage to the exterior from both axial ends of each ferrite core 2 is suppressed, the eddy currents generated near the lid 51 and the lid seamed portion 52 are weak. Accordingly, the foregoing problem of the local overheating of the drink can 5 can be eliminated so that the buyer's uncomfortable feeling when holding the drink can be effectively prevented.

Further, when the frequency of AC power supplied from the inverter 4 is set to about 7 kHz as mentioned above, the equivalent resistance values of the aluminum can and the steel can approximate to each other in case of a normal can thickness range so that these different-kind drink cans can be induction-heated with approximately the same heat efficiency.

A heating time is determined in advance per column, that is, a volume of the drink can 5 or the like. When the preset heating time has elapsed, the supply of power to the heating coil 1 is stopped and the motor for the foregoing drink can rotating mechanism is stopped. Then, the friction rollers are displaced downward so as to be lower than the upper surface of the pedestal, and thus the drink can 5 is placed on the pedestal. Further, the stopper mechanism, such as the stopper rollers, is off the carrying passage of the drink can 5. Accordingly, the drink can 5 placed on the pedestal of the heating coil 1 is discharged to the outlet via the column chute by its own weight.

In the foregoing preferred embodiments, the aluminum can and the steel can are used as the drink can 5 to be heated. However, even in case of a non-magnetic can other than the aluminum can and a magnetic can other than the steel can, by arranging the resonance circuit to generate a resonance frequency at which equivalent resistance values of those different-kind cans approximate to each other, the induction heating can be applied to those cans with approximately the same heat efficiency. Accordingly, the present invention is not limited to the aluminum can and the steel can. Further, the ferrite core 2 may be replaced by other ferromagnetic cores as occasion demands.

Further, in the foregoing preferred embodiments, the heating coil 1 has a saddle shape for matching or following the circumferential wall of the drink can 5. On the other hand, in case of vending drink cans having different can-body diameters and/or different can lengths, curvature of the heating coil 1 may be so set as to correspond to the circumferential wall of the drink can having the greatest can-body diameter and/or the projected portion of each ferrite core which is located most remotely along the longitudinal axis of the ferrite core,should be located to correspond to the circumferential wall, other than the lid seamed portion, of the shortest drink can. With this arrangement, the induction heating to the different-kind cans can be achieved using the same induction heating apparatus and thus the vending machine, regardless of shapes or sizes of the drink cans. As appreciated, such an arrangement can be easily taken since the circumferential wall of the drink can 5 is held in a non-contact relationship to the end and middle projected portions and the coil surface.

While the present invention has been described in tens of the preferred embodiments, the invention is not to be limited thereto, but can be embodied in various ways without departing from the principle of the invention as defined in the appended claims.

What is claimed is:

1. A drink can induction heating apparatus for induction-heating a drink can in a vending machine, said drink can having a bottomed tubular can body with a drinking liquid contained therein, said apparatus comprising:

a plurality of ferrite cores each having a plurality of projected portions arranged along a longitudinal axis of the drink can and confronting a circumferential wall of the drink can at portions thereof other than at axial ends thereof, said plurality of ferrite cores arranged in a circumferential direction of the drink can so that each of said projected portions is oriented toward the longitudinal axis of the drink can in a non-contact manner when the drink can is temporally held at a given position in the vending machine, each of said ferrite cores further having one or more recesses formed between the projected portions;

a saddle-shaped heating coil having a central open portion and received in the recesses of said ferrite cores with said central open portion receiving therethrough at least one of said projected portions of each of said ferrite cores, said heating coil having a coil surface which covers a portion of the circumferential wall of said drink can in a non-contact manner; and an inverter including a resonance circuit for producing AC power at a given frequency for feeding to said heating coil, said given frequency being no greater than a value where a current penetration depth becomes about five times a thickness of the circumferential wall of the drink can in case the drink can is formed of a non-magnetic material, said resonance circuit including a resonance capacitor having a given capacitance and said heating coil which are connected electrically in one of series and parallel, wherein, when the AC power is fed to said heating coil, one or more magnetic circuits are formed between said projected portions of each of said ferrite cores and the circumferential wall of the drink can confronting said projected portions.

2. The drink can induction heating apparatus according to claim 1, wherein said given frequency is one of frequencies 5 kHz to 15 kHz where equivalent resistance values of a non-magnetic material and a magnetic material used in the bottomed tubular can bodies approximate to each other.

3. A drink can induction heating apparatus for induction-heating a drink can in a vending machine, said drink can having a bottomed tubular can body with a drinking liquid contained therein, said apparatus comprising:

a ferrite core having a plurality of projected portions arranged along a longitudinal axis of the drink can and confronting a circumferential wall of the drink can at portions thereof other than at axial ends thereof, each of said projected portions extending in a circumferential direction of the drink can so as to be oriented toward the longitudinal axis of the drink can in a non-contact manner when the drink can is temporally held at a given position in the vending machine, said ferrite core further having one or more recesses formed between the projected portions;

a saddle-shaped heating coil having a central open portion and received in said one or more recesses with said central open portion receiving therethrough at least one of said projected portions of the ferrite core, said heating coil having a coil surface which covers a portion of the circumferential wall of said drink can in a non-contact manner; and an inverter including a resonance circuit for producing AC power at a given frequency for feeding to said heating coil, said given frequency being no greater than a value where a current penetration depth becomes about five times a thickness of the circumferential wall of the drink can in case the drink can is formed of a non-magnetic material, said resonance circuit including a resonance capacitor having a given capacitance and said heating coil which are connected electrically in one of series and parallel, wherein when the AC power is fed to said heating coil, one or more magnetic circuits are formed between said projected portions of said ferrite core and the circumferential wall of the drink can confronting said projected portions.

4. The drink can induction heating apparatus according to claim 3, wherein said given frequency is one of frequencies 5 kHz to 15 kHz where equivalent resistance values of a non-magnetic material and a magnetic material used in the bottomed tubular can bodies approximate to each other.

* * * * *